United States Patent [19]

Sussman

[11] Patent Number: 4,621,935

[45] Date of Patent: Nov. 11, 1986

[54] METHOD OF FILLING A COSMETIC CONTAINER WITH PUSH-UP ACTUATOR

[75] Inventor: Morris Sussman, Freeport, N.Y.

[73] Assignee: Shore Plastics Inc., Freeport, N.Y.

[21] Appl. No.: 197,496

[22] Filed: Oct. 16, 1980

[51] Int. Cl.[4] ..... B43K 21/00

[52] U.S. Cl. ..... 401/82; 220/200; 29/447

[58] Field of Search ..... 401/82, 88, 98, 49; 220/203, 19, 200, 201; 215/246, 358, 362; 29/447

[56] References Cited

U.S. PATENT DOCUMENTS

| | | | |
|---|---|---|---|
| 2,250,045 | 7/1941 | Focke et al. | 220/201 |
| 3,305,082 | 2/1967 | Orr | 220/201 X |
| 3,443,874 | 5/1969 | Pelli et al. | 401/82 |
| 4,037,754 | 7/1977 | Wilhelmi et al. | 220/361 X |
| 4,049,151 | 9/1977 | Schneiso | 220/201 |
| 4,133,094 | 1/1979 | Stofford | 29/447 |

OTHER PUBLICATIONS

Oberg et al, *Machinery's Handbook*, 20th Edition, 1978, p. 1549.

*Primary Examiner*—Edward M. Coven
*Attorney, Agent, or Firm*—Michael Ebert

[57] ABSTRACT

A method for filling a container for a cosmetic which initially is in a heated liquefied state and which assumes a solid form at ambient temperature. The container includes an open-ended cylindrical case whose bottom end is provided with a lip acting as an end stop with respect to a piston-type actuator slidable therein, the upper portion of this case being threaded to receive a screw-on cap within which is nested a removable filling cup which closes the top end of the case. The actuator is provided with a filling hole making it possible when the actuator occupies its stop position to fill the container from the bottom with the liquefied cosmetic. When the liquefied cosmetic filling the container solidifies, it forms a solid column therein that is seated on the actuator and is raised thereby. The actuator hole is sealed by a plug of a material having a high thermal coefficient of expansion, the plug being deposited in the hole in a cold state in which its diameter is slightly less than that of the hole. When at ambient temperature, the plug then has an enlarged diameter causing it to tightly fit within the hole to provide an intimate seal therefor.

1 Claim, 8 Drawing Figures

Fig. 1.
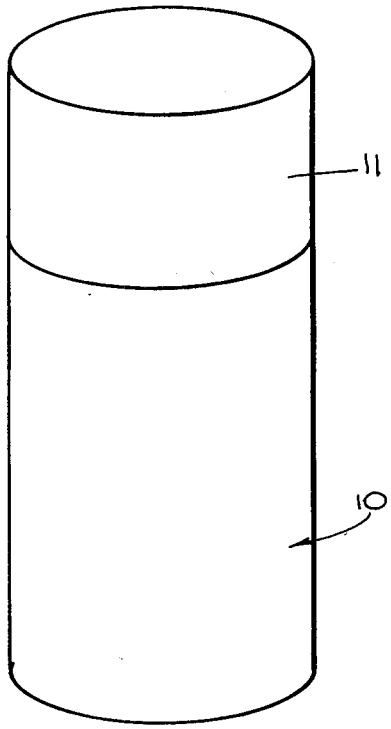
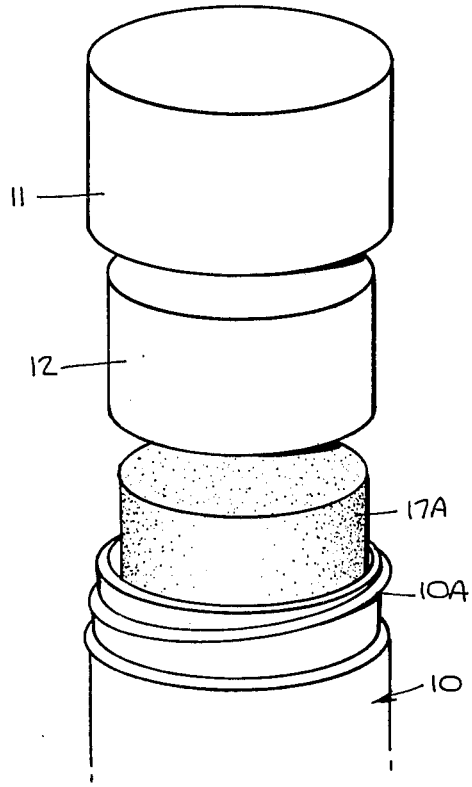
Fig. 3.
Fig. 4.
Fig. 2.
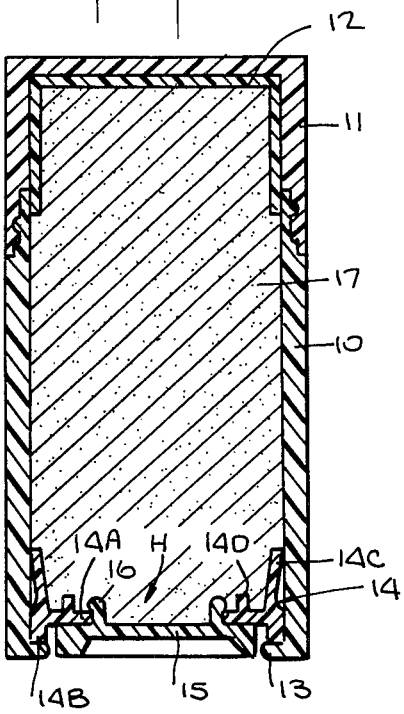
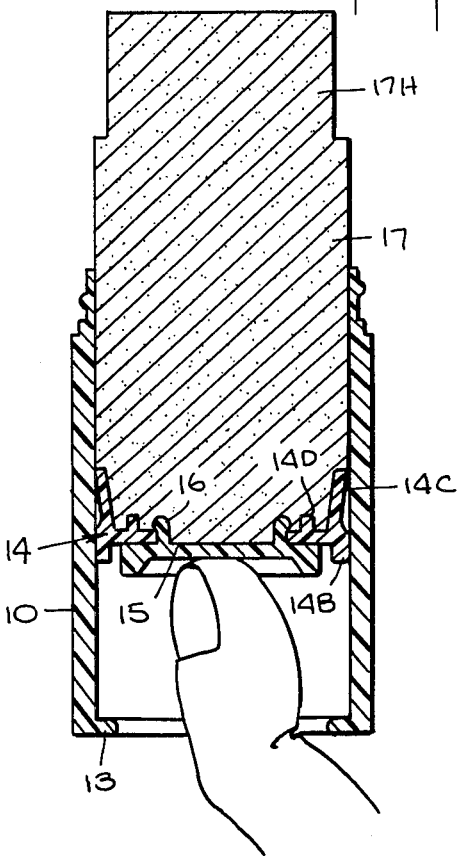

METHOD OF FILLING A COSMETIC CONTAINER WITH PUSH-UP ACTUATOR

BACKGROUND OF INVENTION

This invention relates generally to cosmetic containers such as a deodorant stick, and more particularly to a technique for filling a cosmetic container of the push-up type with a cosmetic which initially is in a hot liquefied state and which assumes a solid state at ambient temperature within the container.

A technique according to the invention is applicable to any cosmetic whose constituents are in a molten or liquefied state when heated, the liquid thereafter cooling to assume at ambient temperature a solid or wax-like form. While the invention will be described in conjunction with a deodorant whose constituents have these properties, it is to be understood that the invention is applicable to other cosmetics.

The composition of a typical deodorant stick consists of propylene glycol, sodium stearate, alcohol, fragrance and water. A deodorant stick having these ingredients is usually packaged in a capped container which functions also as an applicator. The container for this purpose is an open-ended cylindrical case within which is received a push-up actuator that normally acts as a piston that rests on an annular lip at the bottom of the case, the actuator serving as a base socket for a column of deodorant material.

The head of the deodorant column projects above the upper end of the case which is threaded to receive a screw-on cap that covers the head. To use the deodorant stick, the cap is unscrewed to expose the head of the column which may now be rubbed onto the underarm region of the user. With continued use, the head is rubbed away until a point is reached where it becomes necessary for the user to push up the actuator at the bottom of the case to an extent creating a fresh head. This procedure is repeated from time to time, the actuator advancing upwardly in steps until the deodorant column is exhausted.

The standard procedure in filling a container case of this type is to place the case in a fixture in an upright position, with the push-up-actuator resting on the bottom lip. The fixture is designcd to form a receptacle at the upper end of the case to avert overflow of the liquefied deodorant onto the threads of the case. The actuator has a cup-like formation whose circular wall formed of resilient plastic material engages the inner surface of the rigid case.

The case in this upright position is then filled through its open top by pouring the deodorant composition therein in its liquefied state. The composition is then permitted to cool and solidify to form a column. Finally, excess material is scraped from the upper end of the column to provide a presentable head, after which the cap is screwed on to seal the package.

A top-filling procedure of the above-described type is a relatively costly and time-consuming operation, not only because it entails the step of placing the case in a fixture but also because it requires a cooling period which must be completed before the column head can be scraped and the cap then screwed onto the case.

There are many advantages to be gained in a bottom-filling procedure for a push-up type container, for then one could do away with the need for a fixture and for a cooling period followed by a scraping step. But while bottom-filling procedures have been carried out with so-called propel-type cosmetic containers, it has not heretofore been possible with push-type containers.

In a propel-type container, a rotatable ring at the bottom of the case is attached to the lower end of a tube coaxially disposed within the case. Threadably received within the tube is a hollow pipe whose upper end terminates in an enlarged circular socket whose side wall engages the wall of the case. The side wall of the socket has a notch therein which rides on a rib extending along the inner surface of the case so that the socket and pipe are free to move axially but not to rotate. Rotation of the ring acts to rotate the tube with respect to the hollow pipe threadably received therein, thereby propelling the socket up and down in the case, depending on the direction of ring rotation.

A propel-type container of this type is filled downside up with liquefied cosmetic which is poured through the tube and the hollow pipe into the case which is enclosed by a removable filling cap. When filling is completed, a sealing plug is snapped into place on the ring. Because the socket which is designed to hold the product is retained by the threads of the propel mechanism, the pressure that must be exerted when snapping in the plug does not displace the socket.

Even though a propel-type container can advantageously be filled from the bottom, it has certain practical drawbacks. The propel mechanism is more complex than the simple actuator in a push-up container and is substantially more expensive to manufacture and assemble. Moreover, the mechanism occupies a significant portion of the case and therefore cuts down the effective capacity of the container. On the other hand, one cannot fill the conventional push-up type container from the bottom; for if the push-up actuator therein were provided with a filling orifice adapted to accommodate a sealing plug, the pressure exerted in snapping the plug in place would advance the push-up actuator and squeeze out the liquefied cosmetic.

If instead of using a snap-in plug to seal the filling orifice one were to drop in a sealing plug in an orientated position and rotate this plug 90° to secure it in place, an adequate seal would not be obtainable. The reason for this is that in a plug that must be rotated to lock it, clearances are required for rotation and this is incompatible with an effective seal when the product, as in the case of a deodorant, has a high alcoholic content and an imperfect seal results in evaporation.

SUMMARY OF INVENTION

In view of the foregoing, the main object of this invention is to provide a cosmetic container of the push-up actuator type which lends itself to bottom filling, thereby obviating the need to support the container in a fixture during the filling operation.

More particularly, an object of this invention is to provide a technique for filling a cosmetic container of the push-up actuator type with a liquefied cosmetic in which the container is sealed while the filled container is still in the liquefied state, thereby eliminating the need for a cooling and scraping step. In this way, production time ordinarily lost in cooling is saved. Moreover, because the liquid cools and solidifies within the sealed container, the cosmetic column formed thereby requires no scraping to render it presentable.

A significant feature of the invention is that the push-up actuator is provided with a filling hole which is closed after bottom filling with a sealing plug which requires no pressure or rotation to effect an intimate seal. It is important in the context of cosmetics, such as a deodorant having a high alcoholic content that is highly susceptible to evaporation, that the seal be as perfect as possible, this being achieved by means of a sealing plug formed of a material having a high thermal coefficient of expansion.

Briefly stated, these objects are attained in a container for a cosmetic which initially is in a hot, liquefied state and which assumes a solid form at ambient temperature. The container includes an open-ended cylindrical case whose bottom end is provided with an annular lip acting as an end stop with respect to a piston-type actuator slidable within the case, the upper portion of this case being threaded to receive a screw-on cap within which is nested a removable filling cup which closes the top end of the case.

The actuator is provided with a filling hole making it possible to fill the container from the bottom with the liquefied cosmetic which when solidified forms a solid column therein that is seated on the actuator and is raised thereby. The hole is sealed by a plug whose material has a high thermal coefficient of expansion, the plug being deposited in the hole in a cold state in which its diameter is slightly less than that of the hole. When thereafter at ambient temperature the plug has an enlarged diameter causing it to tightly fit within the hole to provide an intimate seal therefor.

OUTLINE OF DRAWINGS

For a better understanding of the invention as well as other objects and further features thereof, reference is made to the following detailed description to be read in conjunction with the accompanying drawing, wherein:

FIG. 1 is a perspective view of a push-up type cosmetic container in accordance with the invention;

FIG. 2 is a longitudinal section taken through the container;

FIG. 3 is an exploded view of the upper end portion of the container;

FIG. 4 shows the manner in which the column of cosmetic is raised within the case of the container;

DESCRIPTION OF INVENTION

The Container Structure

Figure 5:
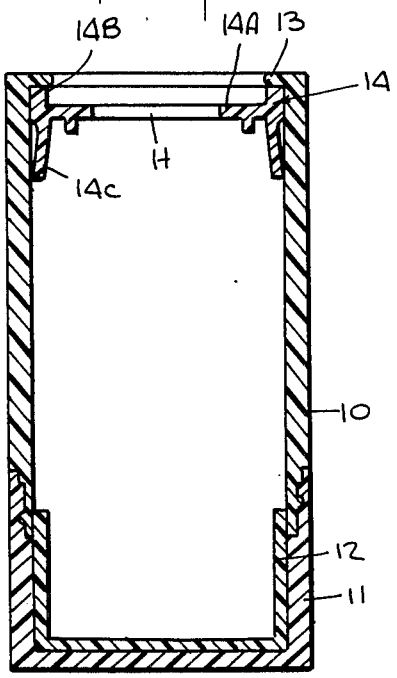
FIG. 5 illustrates in section the container with its bottom end up in readiness for filling.
Figure 8:
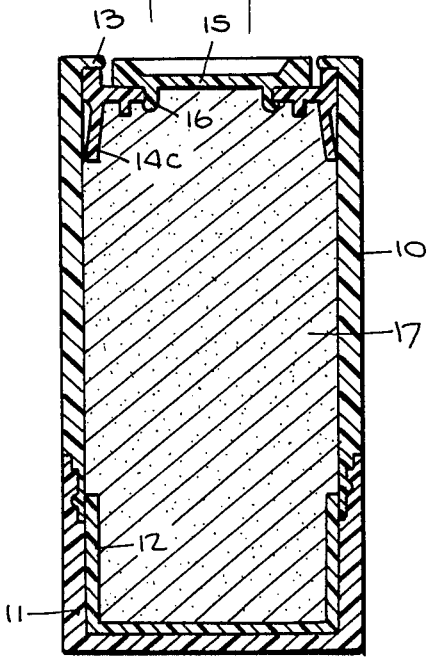
FIG. 8 shows the container filled and sealed.

Referring now to FIGS. 1 to 3, the push-up cosmetic container in accordance with the invention comprises an open-ended cylindrical case 10 having an externally-threaded upper end 10A adapted to receive a screw-on cap 11 within which is nested a removable filling cup 12.

Formed on the lower end of case 10 is an inwardly-directed annular lip 13 defining an end stop for a push-up actuator 14 slidably disposed within the case. Case 10 and cap 11 are preferably formed of a rigid opaque synthetic plastic material such as an ABS resin or polystyrene, the filling cup being preferably fabricated of a transparent plastic material such as an acrylic. Actuator 14, because it acts as a slidable piston within case 10, is formed of a somewhat flexible synthetic plastic material such as polyethylene.

Actuator 14 includes a circular base 14A having a central filling hole H therein. Projecting downwardly from base 14A is an annular pedestal 14B which, when the actuator occupies its zero position, is seated on end stop 13. Projecting upwardly from base 14A is a somewhat conical shell section 14C whose upper end frictionally engages the inner surface of case 10. Base 14A and shell section 14C form a socket for the deodorant stick, as will be later explained.

Filling hole H is sealed by a disc-shaped plug 15 having raised on its inner face a central ring 16. This ring is received within filling hole H and is pressed against the circular bank thereof to effect an intimate seal therewith.

The container is filled with a stick or column 17 of deodorant whose lower end is socketed within shell 14C of actuator 14. Since this cosmetic is introduced into the container in liquefied form through filling hole H, the container acts as a mold to define the stick which solidifies within the container. Base 14A of actuator 14 is provided with a circular rib 14D to stabilize the stick in the socket.

FIGS. 1 and 2 show the container in an upright position after being filled upside down through hole H with a liquefied cosmetic, the container then being sealed by plug 15 and returned to its normal upright position, in which position the liquefied cosmetic is permitted to solidify. When the purchaser first acquires this container, in order to put it to use he must unscrew cap 11, as shown in FIG. 3, and then take filling cup 12 off the head 17A of the deodorant column 17. This cup is no longer necessary and may be discarded or put to some other practical use.

Then the purchaser is able to use the cosmetic in its intended manner by rubbing head 17A onto the underarm region of the body. After head 17A is rubbed away, the actuator 14, as shown in FIG. 4, is pushed up to the necessary extent to create a fresh head, this being done by pressing against sealing plug 15 with the finger. The underside of sealing plug 15 is in a depressed formation to receive the finger.

Filling Procedure

Referring now to FIG. 5, there is shown an empty container which is in an upside-down position in a condition to be filled through unplugged hole H in actuator 14 which then occupies its zero position. Because shell section 14C frictionally engages the inner surface of case 10, the actuator is retained in its zero position with pedestal 14B resting on end stop 13.

Figure 6:
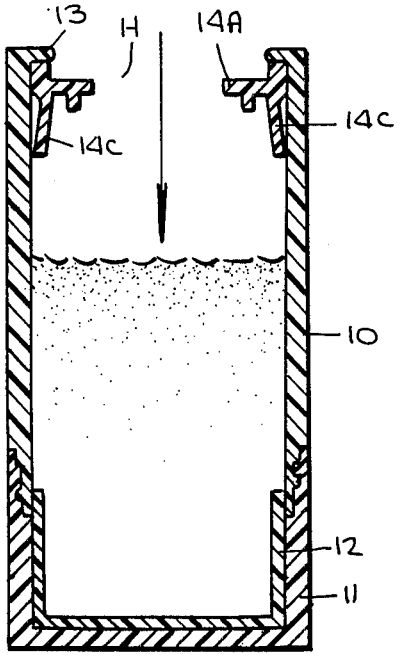
FIG. 6 shows the container being filled.

The cosmetic in its hot liquefied state is poured into the container through hole H, as shown in FIG. 6. Filling continues until the level of the liquid almost reaches that of base 14A of the actuator.

Figure 7:
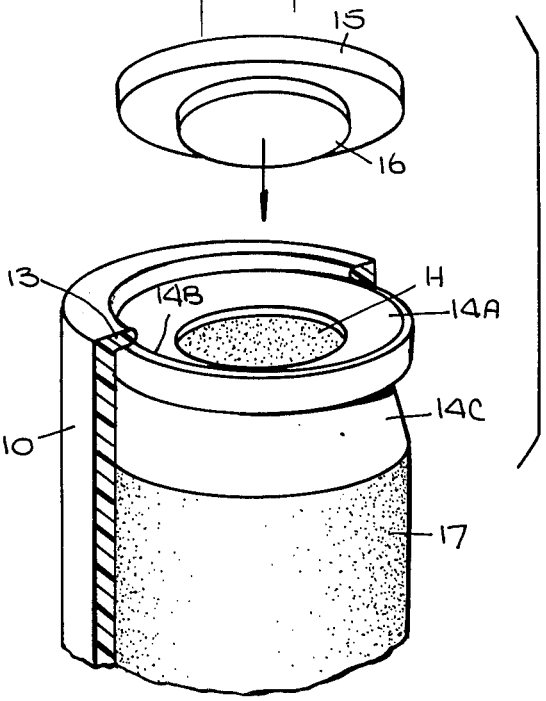
FIG. 7 illustrates the manner in which the sealing plug is deposited into the filled container.

At this point, it is necessary to seal the container. As shown in FIG. 7, plug 15, which is formed of a material such as polyethylene having a high thermal coefficient of expansion, is supplied by a suitable dispenser that is positioned above the container so that the ring 16 of the plug falls into hole H.

In the dispenser, the plug is refrigerated to an extent causing contraction of the plug so that the diameter of ring 16 is slightly less than that of hole H to permit the ring to fall neatly into the hole. To this end, the dispenser may be constituted by a vertically-positioned tube adapted to accommodate a stack of plugs, the tube being surrounded by a cooling jacket through which there is circulated a suitable coolant such as anhydrous ammonia supplied by an associated refrigeration system.

The dispenser arrangement is such that as the liquid-filled containers in their upside-down position are advanced one by one by a suitable conveyor under the raised plug dispenser, a plug is released by the dispenser and dropped onto the container so that ring 16 is received within hole H.

The container having the plug applied thereto then travels through a warming zone to cause the plug to expand such that when it reaches ambient temperature, ring 16 in hole H is sufficiently enlarged to bring about a tight seal therewith.

Since the liquefied cosmetic filling the container is at an elevated temperature, it acts to warm the plug and cause it to expand to bring about the necessary tight seal in a short period. Then the sealed container is turned over to assume its normal upright position as shown in FIG. 1, the liquefied cosmetic therein gradually solidifying as the temperature of the cosmetic is reduced to the ambient temperature level.

While there has been shown and described a preferred embodiment of a cosmetic container with push-up actuator in accordance with the invention, it will be appreciated that many changes and modifications may be made therein without, however, departing from the essential spirit thereof.

I claim:

1. The method of filling and sealing a container with a liquefied cosmetic having a high alcohol content, said container having an open-ended cylindrical case whose upper end is externally threaded to receive a screw-on cap and whose bottom end is provided with an inwardly directed lip on which a push-up actuator rests, the actuator having a base provided with a filling hole having a predetermined diameter, the method comprising the steps of:

A. pouring the liquefied cosmetic into the hole with the container upside down until the level of liquid in the container reaches the actuator, at which point the container is filled;

B. cooling a plug formed of a plastic material having a high thermal coefficient, said plug having a raised ring on its inner face which when the plug is cold has a diameter slightly smaller than that of the hole;

C. dropping said cold plug onto the base of said upside-down container to cause the ring to fall into said hole, the ring thereafter expanding when it reaches ambient temperature to seal said hole; and D. placing the sealed and filled container in an upright position to permit the liquefied cosmetic to solidify.

* * * * *